US006123582A

United States Patent [19]

Ko et al.

[11] Patent Number: 6,123,582

[45] Date of Patent: Sep. 26, 2000

[54] MICRO CONNECTOR ASSEMBLY WITH GROUNDING SHIELD

[75] Inventors: David Tso-Chin Ko, Thousand Oaks; Eric Juntwait, Irvine, both of Calif.

[73] Assignee: Hon Hai Precision Ind. Co., Ltd., Taipei Hsien, Taiwan

[21] Appl. No.: 09/351,992

[22] Filed: Jul. 12, 1999

[51] Int. Cl.[7] ..... H01R 13/648

[52] U.S. Cl. ..... 439/579; 439/610

[58] Field of Search ..... 439/497, 579, 439/610

[56] References Cited

U.S. PATENT DOCUMENTS

| | | | |
|---|---|---|---|
| 4,365,856 | 12/1982 | Yaegashi et al. | 439/579 |
| 4,379,608 | 4/1983 | Olsson et al. . | |
| 4,602,832 | 7/1986 | Cunningham et al. | 439/579 |
| 4,993,968 | 2/1991 | Guletsky et al. | 439/579 |
| 5,085,596 | 2/1992 | Bowen et al. | 439/497 |
| 5,241,135 | 8/1993 | Fetzer | 439/579 |
| 5,871,369 | 2/1999 | Ohayashi et al. . | |
| 5,980,308 | 11/1999 | Hu et al. | 439/579 |
| 6,024,597 | 2/2000 | Lok | 439/497 |
| 6,027,367 | 2/2000 | Woertz et al. | 439/497 |

*Primary Examiner*—Gary F. Paumen
*Attorney, Agent, or Firm*—Wei Te Chung

[57] ABSTRACT

A micro coaxial cable connector assembly for contact with a mating electrical connector, includes a first and second housing members, a cable set with a plurality of cables, an upper and lower shield members, and a plurality of contacts. The cable set consists of the cables each having at least a signal segment and a grounding segment, and a grounding bar soldered with the grounding segments of the cables. The upper and lower shield members attached onto the first housing member are engagingly jointed with each other and electrically contact with a shield member of the mating connector. Meanwhile, the upper shield member further forms a plurality of spring fingers further extending inside the first housing member to electrically engage with the grounding bar of the cable set received therein. Therefore, a grounding path from the cables to the mating connector can be fully established.

15 Claims, 8 Drawing Sheets

MICRO CONNECTOR ASSEMBLY WITH GROUNDING SHIELD

BACKGROUND OF THE INVENTION

1. Field of the Invention

The present invention relates to a micro connector assembly for link with a remote micro coaxial cable, and particularity to a micro connector assembly for electrical and mechanical contact with an external mating connector.

2. The Prior Art

In a conventional micro connector as introduced in U.S. Pat. No. 5,871,369 and Japanese Patent Publication No. 09-055243, a plurality of conductive cores 21 through 26 of a flat cable 17 are respectively fitted into several notches 31 through 36 defined inside a main body 10 of the connector 1. An elongated contact bar 18 composed of an insulating material is then placed inside a groove 28 of the main body 10 defined perpendicular to a longitudinal axis of each notch 31 thereby locating above the conductive cores 21 through 26 in perpendicular relationship. Eventually, an insulative cover 19 is restrainedly attached above the main body 10 to press down the conductive cores 21 through 26 via the contact bar 18. Thus, the conductive cores 21 through 26 each relatively deflects down a spring contact arm 14*a* of one of the contacts 14 in a main body 10 of the connector 1 thereby establishing electrical connection between the cable 17 and the contacts 14. Another conventional design on the micro connector like Japanese Patent Publication Nos. 10-321314 and 10-255921 introduces that a cable holder of the connector defines a row of U-shaped grooves at a front end for reception of the corresponding conductive cores of the coaxial cable therein. When the grooves of the cable holder are respectively fitted and inserted between a tuning fork type tips of the corresponding contact, the upper and lower side tips of the contacts are brought to press down the conductive cores on one side/reversed sides of the U-shaped grooves.

However, the mentioned-above micro connectors all lack an efficient conductive shield at the outmost thereof to establish a grounding protection from an undesired external EMI (Electromagnetic Interference) or ESD (Electrostatic Discharge). It may be reasonable that the separated assembly of the housing with the cable or the cable holder increase complicate the design on an additional shield means, especially in grounding with the cable. A complicated shield means further deepen the difficulty of installing the entire micro connector.

In the present invention, a row of spring fingers formed adjacent to an edge of the shield are designated to ground with a ground bar jointed a grounding segment of each cable (The detail will be described later). In view of the prior art relevant to the spring fingers, an U.S. Pat. No. 4,379,608 discloses a row of spring 28 formed on an edge of a clamping bar 22 for applying evenly distributed clamping pressure along a flat cable and LCD to establish a pressure connection therebetween. It is understood that the springs 28 of the clamping bar 22 received within a housing 2 are not able to provide any electrical access between the flat cable and LCD, even a grounding protection. The transmission of the signal relies on the direct and firm engagement between the cable and LCD under the clamping pressure of the springs 28.

SUMMARY OF THE INVENTION

Accordingly, one object of the present invention is to provide an improved micro connector assembly with a shield means that electrically contacts with a grounding segment of each cable for providing a grounding protection.

Another object of the present invention is to provide the shield means for ease of installation onto the micro connector.

To fulfill the above mentioned objects, according to a preferred embodiment of the present invention, a micro coaxial cable connector, includes a first and second housing members, a cable set with a plurality of cables, an upper and lower shield members, and a plurality of contacts. The first housing member includes a plurality of grooves for reception of the corresponding contacts therein. Each contact consists of a contact section at a free end for electrical contact with the mating connector, and a tail section at an opposite end. The cable set consists of the plurality of cables and the grounding bar. Each cable includes a signal segment and a grounding segment insulated with the signal segment. The grounding bar consists of an upper and lower conductive plates perpendicularly soldered with the grounding segment of each of the cables. The second housing member defines a plurality of passageways for receiving the tail sections of the corresponding contacts therein, and a pair of spaced orientating walls adjacent to the passageways to constitute an elongated slot for receiving the grounding bar jointed with the cables therein. The upper and bottom shield members are attached onto the first housing member in a top-and-bottom direction, and respectively form a plurality of tabs for electrical contact with a shield member of the mating connector, and a plurality of claws formed at opposite lateral edges. Additionally, the upper and lower shield members have an electrical and mechanical engagement with each other by means of the hook of the claws thereof within a recess formed on the first housing member wherein the bent angle of upper and lower claws of the upper and lower shield members interfere with from each other. A plurality of spring fingers formed on the upper shield member extend inside a receiving space of the first housing member to engage with the grounding bar received therein. Therefore, a grounding path from the cables to the mating connector can be fully established.

DETAILED DESCRIPTION OF THE PREFERRED EMBODIMENTS

Detailed reference will now be made to the preferred embodiments of the present invention.

Figure 1:
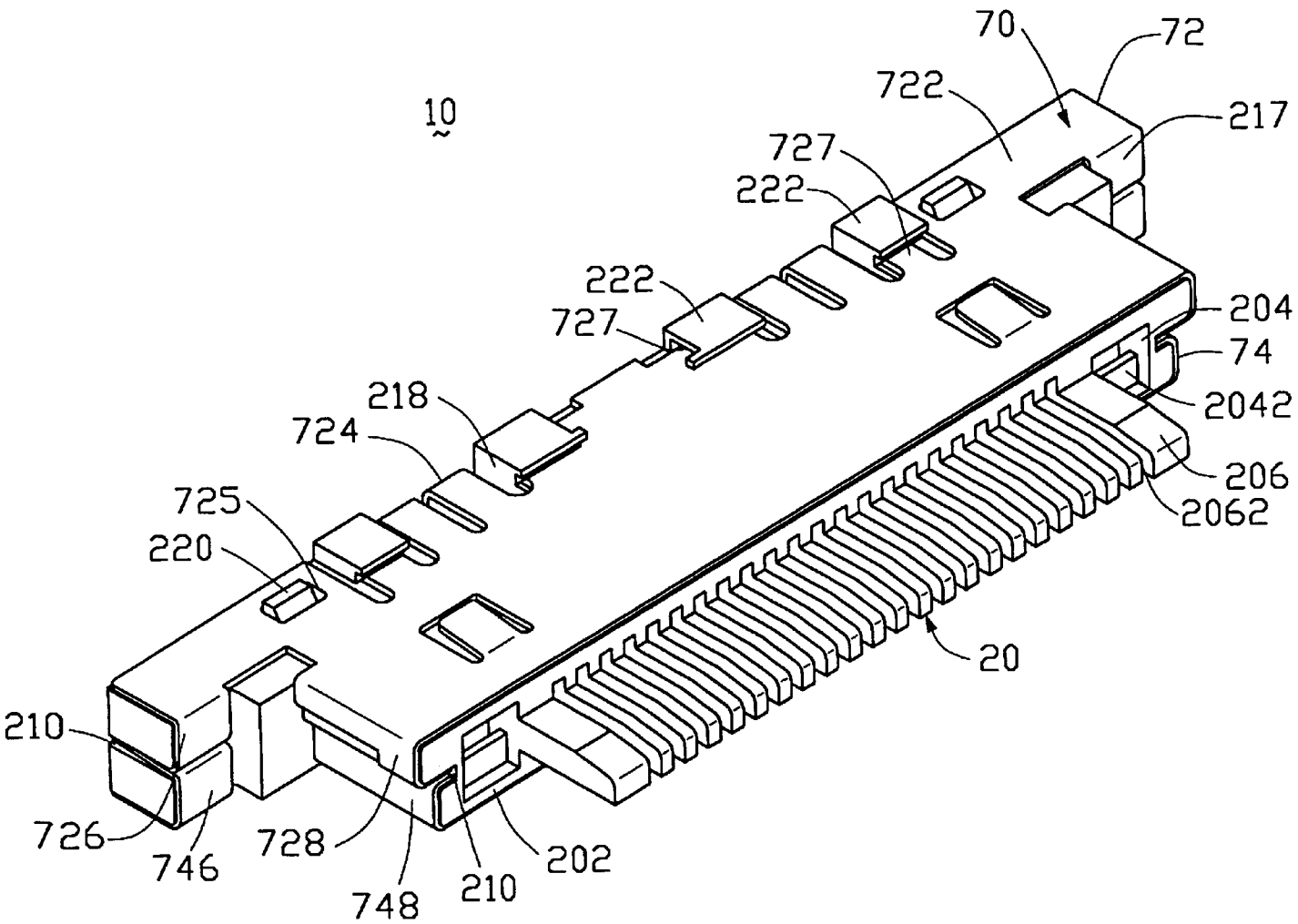
FIG. 1 is a front perspective view of a micro connector assembly in accordance with a preferred embodiment of the present invention.
Figure 2:
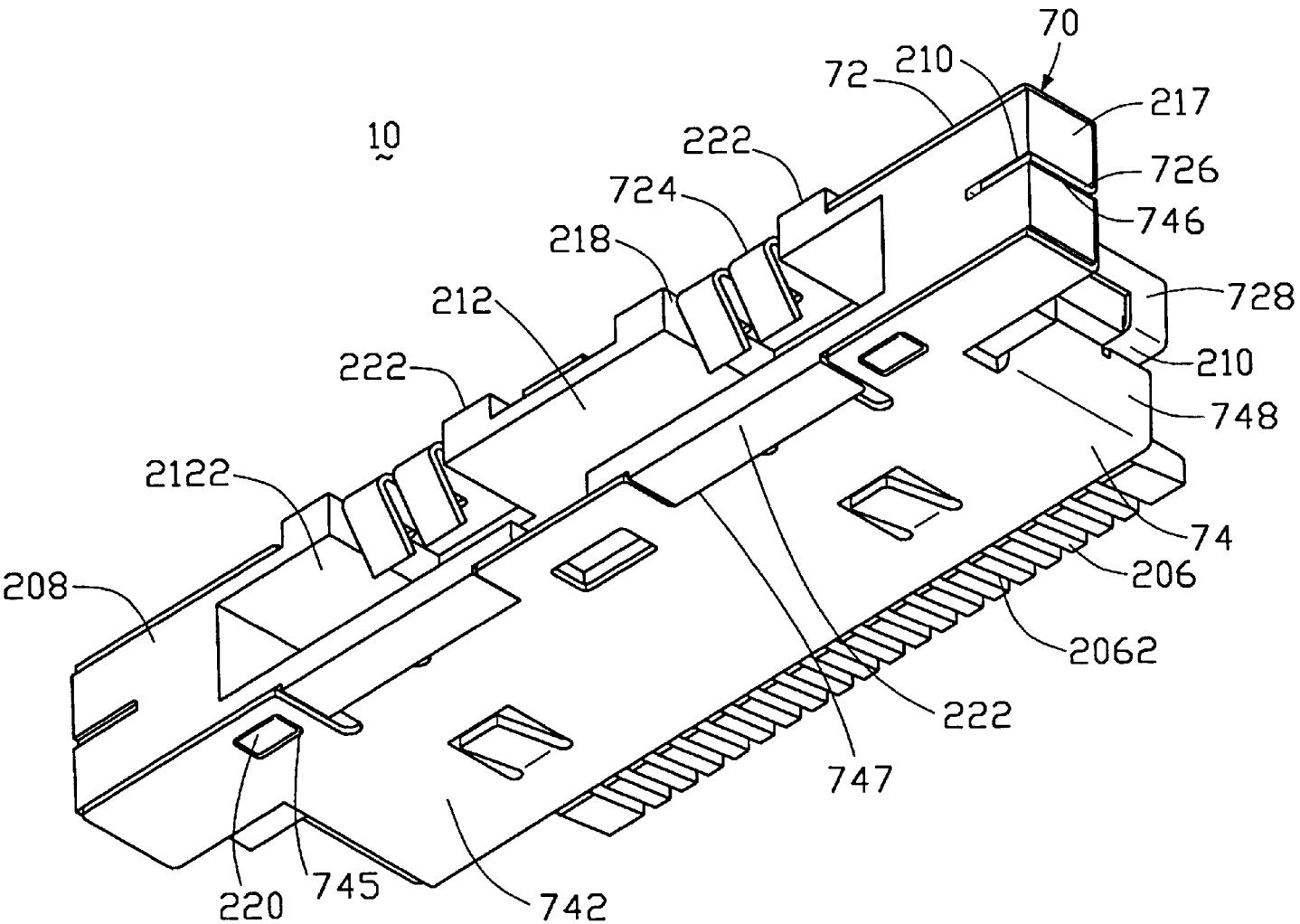
FIG. 2 is a rear perspective view of the micro connector assembly of FIG. 1.
Figure 4:
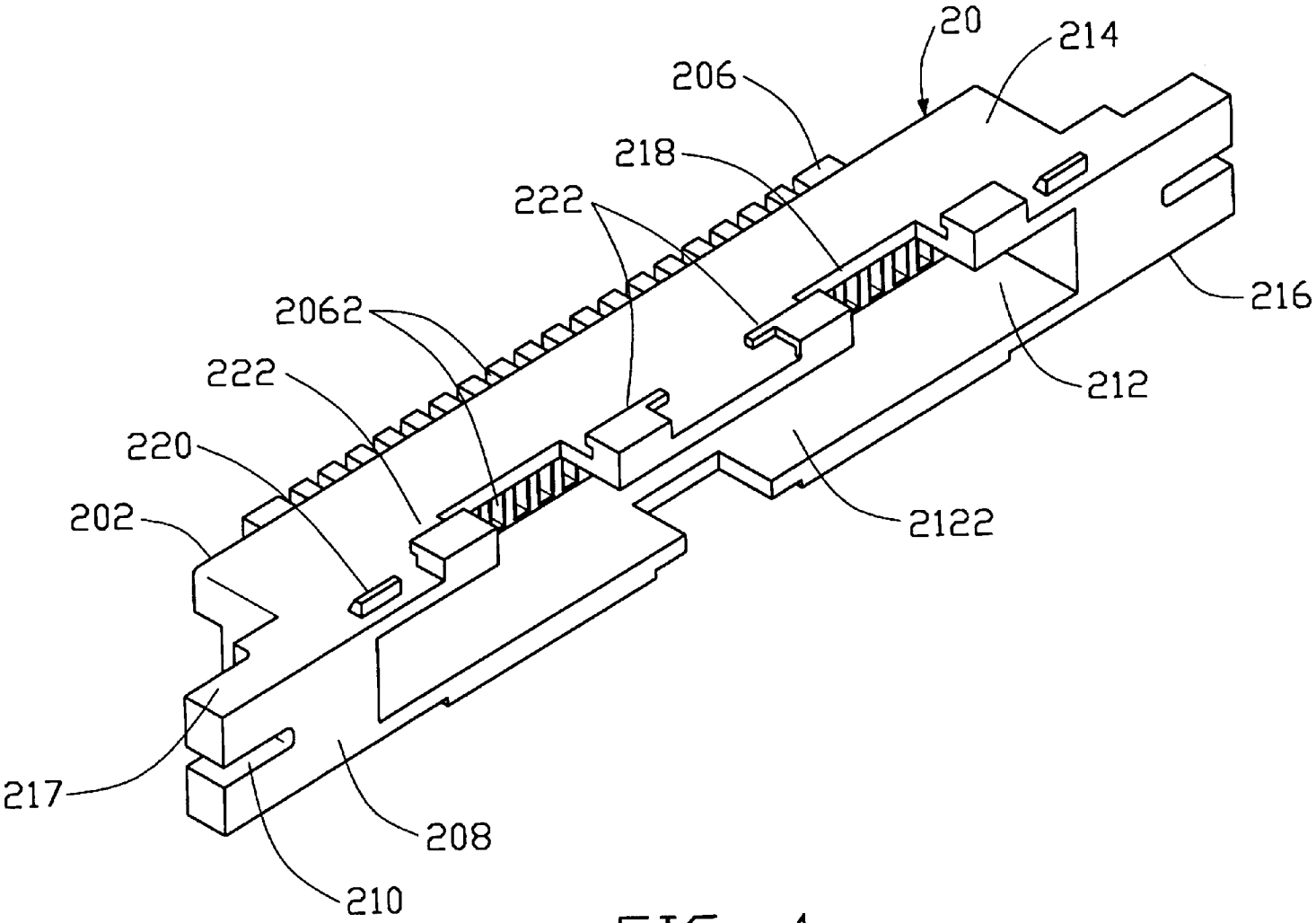
FIG. 4 is a rear perspective view of a front housing member of the micro connector assembly shown in FIG. 1.

Referring to FIGS. 1, 2 & 4, a front housing member 20 of a micro coaxial cable connector 10 for electrically connecting an external mating connector (not shown) with a plurality of cables (see FIG. 7), includes a mating surface 202 and a joint surface 208 opposite the mating surface 202. A tongue portion 206 outwardly extend at a meddle region of the mating surface 202 for inserting into the mating connector. As shown in FIGS. 2 & 4, a receiving space 212 with an opening 2122 is defined between an opposite top and bottom sidewalls 214, 216 of the front housing, through the joint surface 208. A plurality of grooves 2062 horizontally extends through the tongue portion 206 and the mating surface 202 along a front-to-rear direction to communicate with said receiving space 212. A pair of channels 204 formed at opposite lateral sides of the front housing member 20 horizontal extends through both surfaces 202 and 208. A swelling 2042 vertically extends from a specific position on a bottom side of each of the channels 204. A plurality of raises 220 are respectively formed on the top and bottom sidewalls 214, 216. A pair of spaced notches 218 are defined on an rear edge of the top sidewall 214 adjacent to the joint surface 208. A plurality of stopper blocks 222 are disposed on the top and bottom sidewall 214 & 216 wherein the stopper blocks 222 on the top sidewall 214 are respectively distributed on opposite sides of each notch 218. Each stopper block 222 is integrally connected with the corresponding sidewall at a neck thereof thereby constituting a seam (not labeled) therebetween. An ear portion 217 protrudes outwardly from each of opposite lateral sidewalls of the front housing member 20. A recess 210 nearly extends along each lateral sidewalls, including the ear portions 217.

Figure 5:
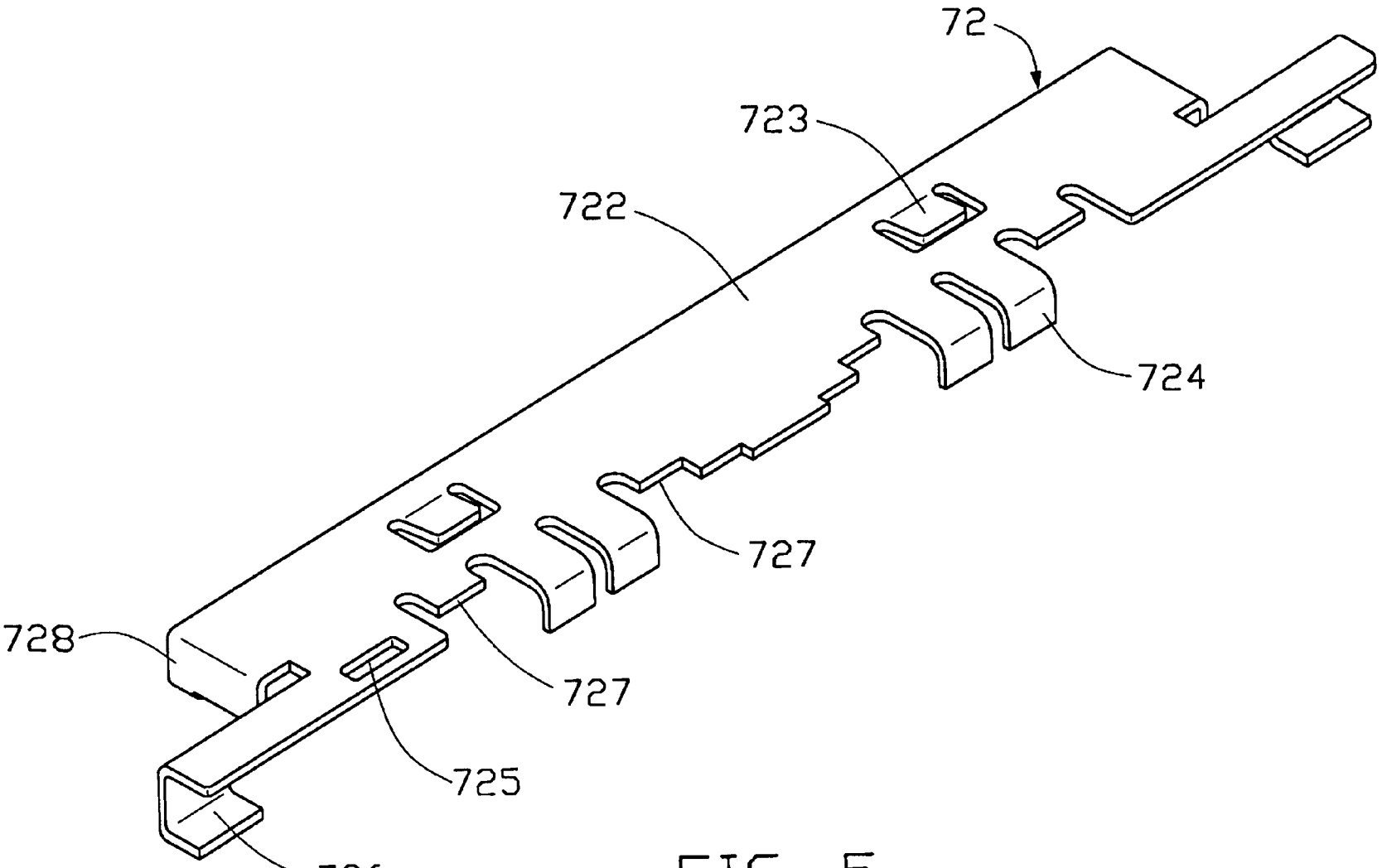
FIG. 5 is a rear perspective view of an upper shield member of the micro connector assembly shown in FIG. 1.
Figure 6:
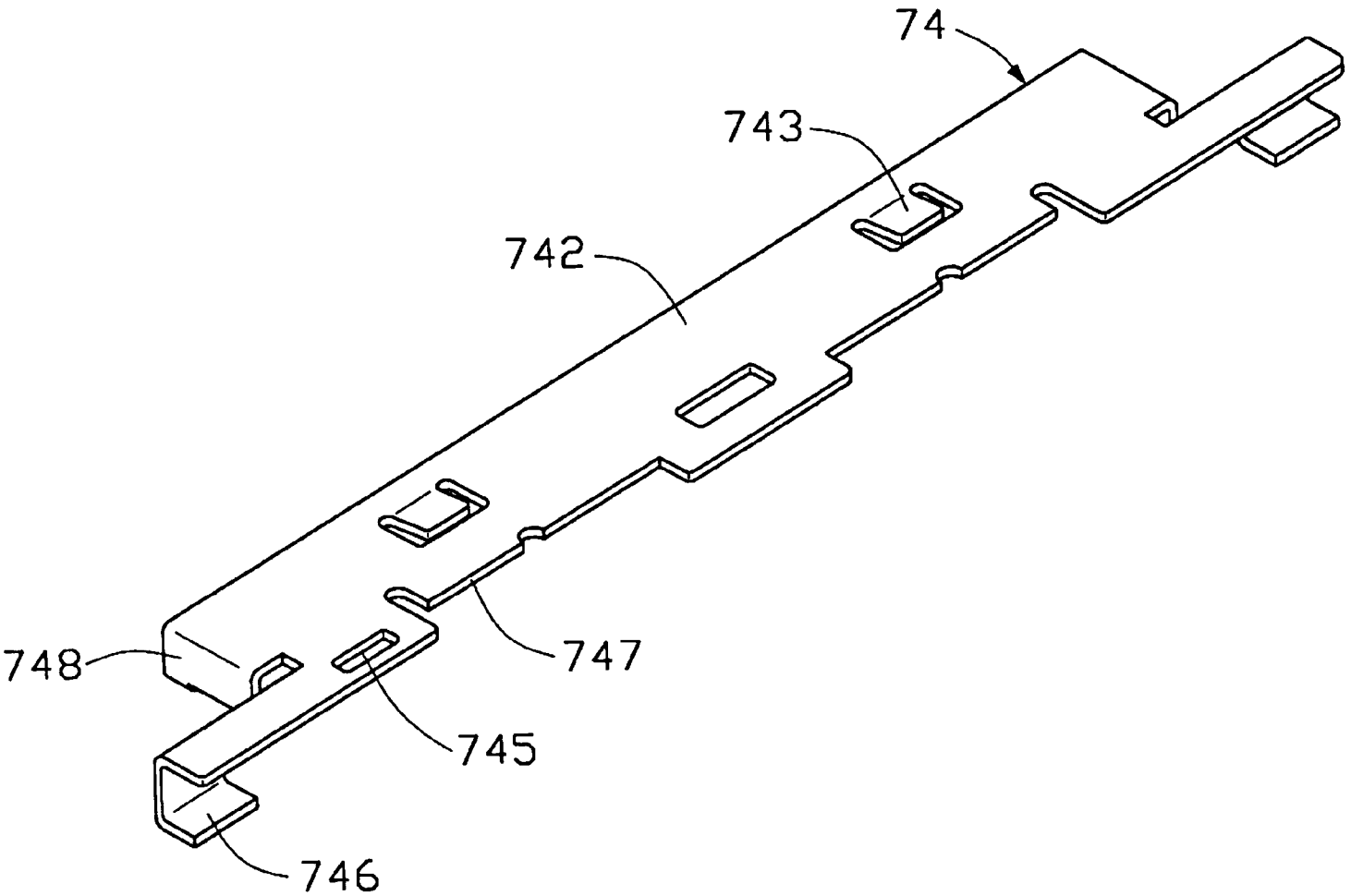
FIG. 6 is a rear perspective view of a lower shield member of the micro connector assembly shown in FIG. 1.

Further referring to FIGS. 5 & 6, a conductive shield means 70 for providence of grounding protection consists of an upper and lower shield members 72, 74. Each shield member 72, 74 further forms a plate portion 722, 742 with opposite bent flanges 728, 748. A pair of claws 726, 746 formed next to the corresponding bent flange 728, 748. Each claw 726, 746 is bent rearward of the corresponding plate portion 722, 742 wherein the bent angle of the claw 746 at a free end thereof is less than that of the claw 726. Several varied abutments 727, 747 are distributed along a rear edge of each plate portion 722, 742. Plural pairs of spring fingers 724 are bent downwardly and inwardly at a specific angle from the rear edge of the plate portion 722 wherein the abutments 727 on the plate portion 722 are formed around the spring fingers 724. A pair of spaced apertures 725, 745 are defined through each plate portion 722, 742. A pair of tabs 723, 743 extend upward from the plate portions 722, 742 for electrical connection with a shield means of the mating connector.

Figure 3:
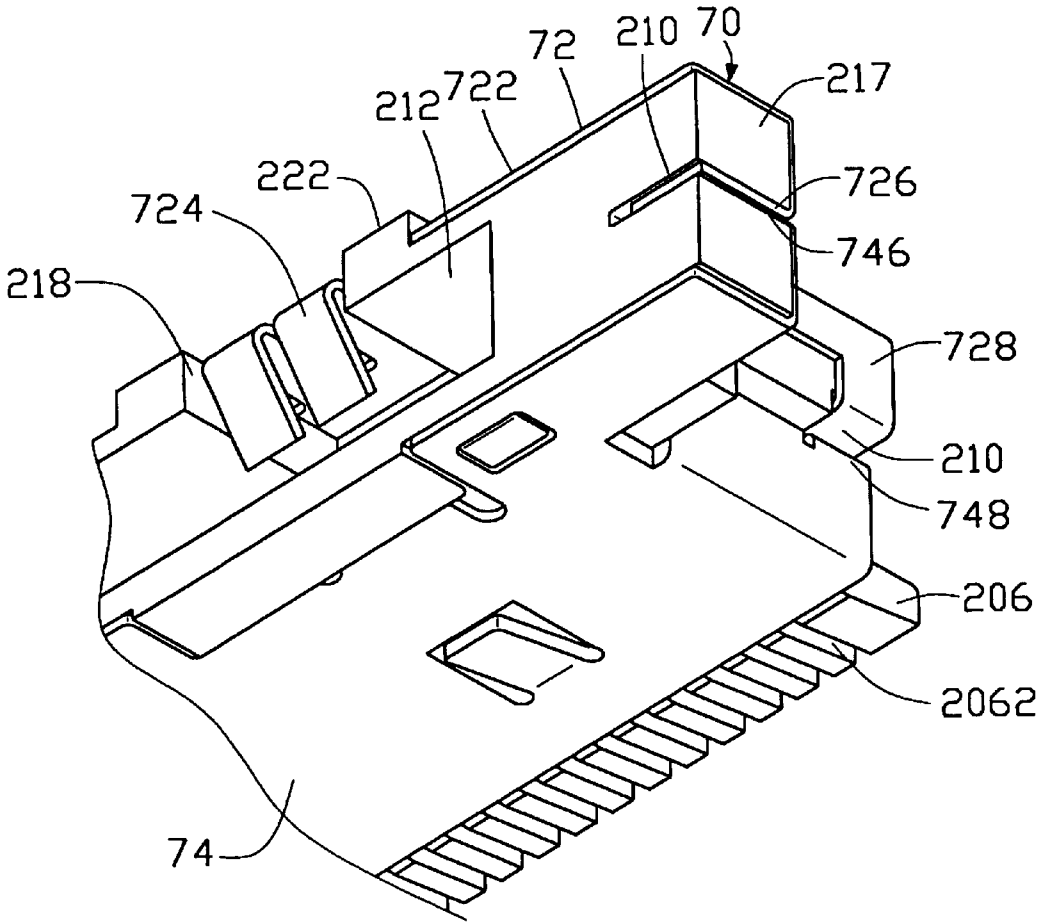
FIG. 3 is a partially enlarged perspective view of the micro connector assembly shown in FIG. 2.

In assembly of the front housing member 20 with the shield means 70 as shown in FIGS. 1–3, the upper and lower shield members 72, 74 are separately attached onto the front housing member 20 along a front-to-rear direction thereby covering the front housing member 20 except both surfaces 202, 208. Meanwhile, the spring fingers 724 of the upper shield member 72 downwardly protrude through the corresponding notches 218 of the front housing member 20 to reach inside the receiving space 212. The varied abutments 727, 747 of the upper and lower shield member 72, 74 are received within the seams of the corresponding stopper blocks 222 formed on the top and bottom sidewalls 214, 216 of the front housing member 20. Hence, the shield means 70 are restricted from horizontally moving on the front housing means 20. The raises 220 of the front housing member 20 respectively protrude through the corresponding aperture 725, 745 of the shield means 70 thereby restricting the shield means 70 from horizontally moving thereon.

As shown in FIGS. 1–3, the bent flanges 728, 748 of the upper and lower shield members 72, 74 inversely hook inwardly within the recesses 210 on the lateral sidewalls of the front housing member 20. Likewise, the claws 726 of the upper shield member 72 inversely hook rearward within the corresponding recesses 210 on the ear portions 217 of the front housing member 20 at a free end thereof at a first angle approximately parallel to the plate 222. The claws 746 of the lower shield member 74 inversely hook rearward within the same recesses 210 as the claws 726 at a free end thereof at a second angle. In recess 210 of each ear portion 217, the second angle of the claw 746 interferes with the first angle of the claw 726 thereby the claw 746 are resiliently pressed down by the claw 726 as shown in FIG. 3. Therefore, the retention of the upper and lower shield members 70, 74 on the front housing member 20 are enhanced by means of a recovering force of the claws 746 exercised on both claws 726, 746. And, the electrical engagement between both claws 726, 746 in a grounding path can be established.

Figure 7:
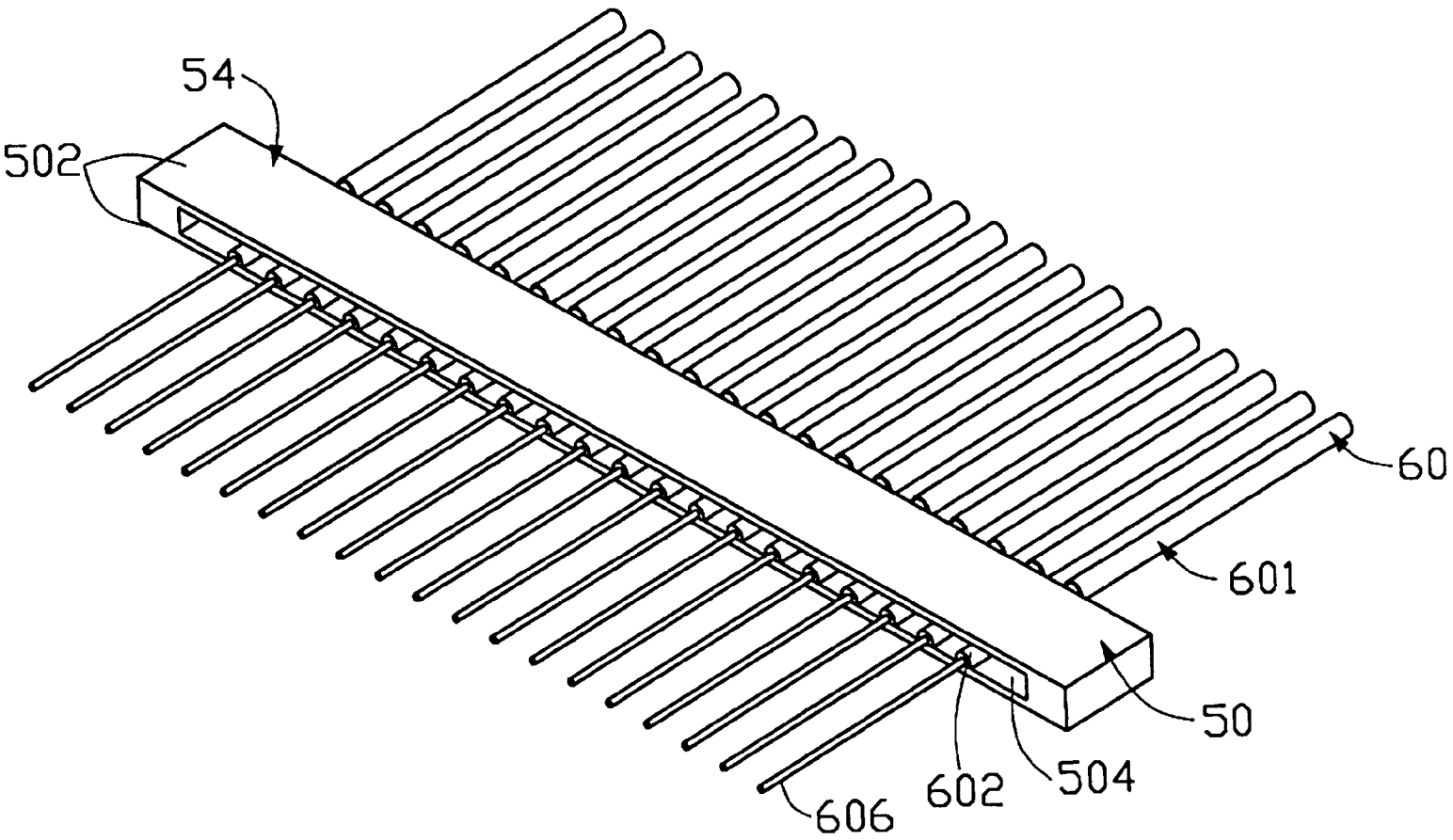
FIG. 7 is a front perspective view of a cable set the micro connector assembly in accordance with the present invention.

A micro coaxial cable set 50 as shown in FIG. 7 consists of a row of juxtaposed coaxial round cables 60 and a conductive grounding bar 54. Each cable 60 is composed of a first insulative layer 601 at the outermost thereof, a grounding jacket layer 602 formed below the first insulative layer 601, a second insulation layer (not shown) formed below the jacket layer 602 and a conductive core 606 at the innermost thereof. The grounding bar 54 is defined with an upper and lower metal plates 502 fixedly jointed at opposite ends thereof and a crack 504 separating both plates 502 from each other.

In FIG. 7, each cable 60 perpendicularly extends through the crack 504 of the grounding bar 54 and clamped between the plates 502. The outermost insulative layer 601 of each cable 60 in part is stripped off to expose the jacket layer 602 as being a grounding segment of the cable 60. Then the grounding segment of each cable 60 are respectively soldered with the inner walls of the upper and bottom plates 502. The cable 60 in part is further stripped off to exposes the conductive core 606 as being a signal segment which extends outside the grounding bar 50 and insulated from the grounding segment by the second insulative layer (not labeled).

Figure 8:
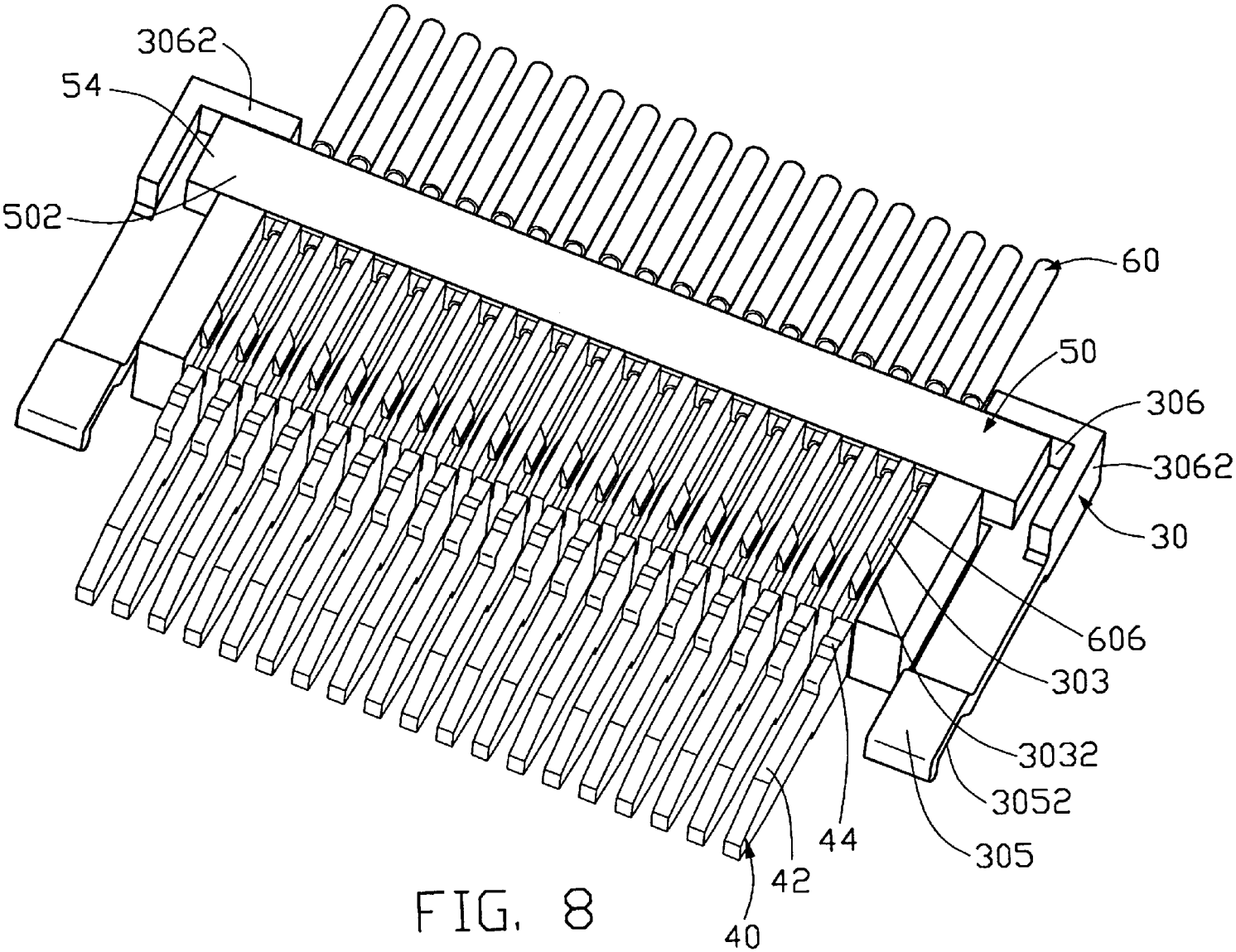
FIG. 8 is an assembled perspective view of a rear housing member of the micro connector assembly with the cable set shown in FIG. 7.

As shown in FIG. 8, a rear housing member 30 is assembled with the cable set 50 and a plurality of contacts 40 therein. The single tip type contact 40 consists of a contact section 42 at a free end thereof, a fins type first retention section 44 with a pair of barbs at a middle region thereof, and a tail section (not labeled) with barbs at an opposed end thereof. A row of spaced passageways 303 adjacent are juxtaposed along a longitudinal axis of a front edge of the rear housing member 30. Each passageway 303 is defined with opposite lateral walls, each lateral wall divided into an upper and lower portion. A pair of protrusions 3032 are formed at the upper portions of opposite lateral walls of each passageway, and define a slope surface at a top tip thereof for guiding the installation of the conductive core 606 of the signal segment of each cable 60 therein. A pair of L-shaped orientating walls 3062 are respectively located at opposite corners adjacent to the rear edge of the member 30 to constitute an elongated slot 306 therebetween. Said the grounding bar 54 jointed with cables 60 are accurately positioned inside the slot 306 by means of the restriction of the orientating walls 3062. A pair of latch portions 305 extend outwardly form said orientating walls 3062. A facing-down bow section 3052 is formed at a free end of each of the latch portion 305.

The tail sections of the contacts 40 are respectively retained below the protrusions 3032 of the corresponding passageways 303. Each of the contacts 40 exposes both the contact section 42 and the first retention contact 44 out of the rear housing member 30.

One of opposite ends of each cable 60 installed inside the rear housing member 30 rearward extends to link with an desired electrical device (not shown). Another end of each cable 60, as a signal segment of exposing the conductive core 606, horizontally enters into the corresponding passageway 303 and is soldered above the tail section 46 of the corresponding contact 40 for enhancement of the electrical and mechanical connection therebetween.

In assembly, the rear housing member 30 as shown in FIG. 8 is inserted inside the receiving space 212 of the front housing member 20 from the opening 2122 of the joint surface 208 as shown in FIG. 2. The contacts 40 disposed within the rear housing member 30 are respectively inserted into the corresponding grooves 2062 of the front housing member 20 from the opening 212 and exposes the contact sections 42 outside the tongue portion 206 for electrical contact with the external mating connector. Each contact 40 is interference fitted with an upper wall of the corresponding groove 2062 by the barb-like first retention section 44 thereof. The latch portions 305 of the rear housing member 30 are inserted within the channels 204 of the front housing member 20 and retained together by the locking of the bow sections 3052 with the swellings 2042. Likewise, each spring finger 724 extending inside the receiving space 212 are engagingly deflected upward by the upper plate 502 of the grounding bar 54. Also, the vertical retention of the stopper block 222 with the abutments 727 can avoid the excessive upward deflection of the spring fingers 724 adjacent the abutments 727. As the result, a ground path is built from the grounding segment of each cable 60, through the grounding bar 54, the upper and lower shield members 70 contact with each other by the claws 726, 746, and the tabs 723, to a shield means of the external mating connector (not shown).

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. A cable connector assembly equipped with a cable set for mating with an external mating connector, comprising:

a plurality of contacts each having a contact section at a free end for electrical contact with the mating connector and a tail section at an opposite end thereof;

a first housing member having a mating surface for contact with the mating connector, a joint surface opposite to the mating surface, and a receiving space defined between both surface and extending through the joint surface to constitute an opening;

the cable set consisting of a plurality of juxtaposed cables each having at least a conductive signal segment and a grounding segment insulated from the signal segment, and a conductive grounding bar firmly jointed with the grounding segments of the cables;

a second housing member having a plurality of passageways each retentively receiving the corresponding contact of which the tail section is fixedly jointed with the corresponding signal segment of the cable set, and at least an orientating section located adjacent to the passageways for restrictedly receiving the grounding bar with jointed the cables therein;

a conductive shield means attached outside the first housing member, forming at least a spring finger downwardly extending into the receiving space wherein as soon as the second housing member is retentively inserted within the receiving space of the first housing member from the opening thereof, the spring finger is engagingly pressed upwardly by the grounding bar thereby establishing a grounding path from the cables to the shield means;

wherein each of the contacts further includes a first retention section at a middle region thereof;

wherein the contact section and the first retention section of the contacts are exposed outside the second housing member;

wherein each of the contacts further comprises a second retention section adjacent to the tail section in interference fit with the corresponding passageway for firmly retaining the contact therein;

wherein the first housing member further defines a plurality of grooves horizontally extending through the mating surface for reception of the corresponding contacts;

wherein the orientating section and the passageways constitute an elongated slot for reception of the grounding bar therein;

wherein the shield means further has at least a tab extending out of the shield means to ground with a shield means of the mating connector thereby further forming a grounding path from the cable to the mating connector;

wherein the first housing member further defines at least a notch communicating with the receiving space for permitting the protrusion of the spring finger therethrough, and a stopper block with a seam distributed around the notch;

wherein the shield means further forms at least an abutment which is restrictedly received within the seam of the stopper block of the first housing member for avoiding the excessive upward deflection of the spring finger.

2. The cable connector assembly as defined in claim 1, wherein each of the contacts further includes a first retention section at a middle region thereof.

3. The cable connector assembly as defined in claim 2, wherein the contact section and the first retention section of the contacts are exposed outside the second housing member.

4. The cable connector assembly as defined in claim 2, wherein each of the contacts further a second retention section adjacent to the tail section in interference fit with the corresponding passageway for firmly retaining the contact therein.

5. The cable connector assembly as defined in claim 1, wherein the first housing member further defines a plurality of grooves horizontally extending through the mating surface for reception of the corresponding contacts.

6. The cable connector assembly as defined in claim 1, wherein the orientating section and the passageways to constitute an elongated slot for reception of the grounding bar therein.

7. The cable connector assembly as defined in claim 1, wherein the shield means further forms at least a tab extending out of the shield means to ground with a shield means of the mating connector thereby further building a grounding path from the cable to the mating connector.

8. The cable connector assembly as defined in claim 1, wherein the first housing member further defines at least a notch communicating with the receiving space for permitting the protrusion of the spring finger therethrough, and a stopper block with a seam distributed around the notch.

9. The cable connector assembly as defined in claim 8, wherein the shield means further forms at least an abutment which is restrictedly received within the seam of the stopper block of the first housing member for avoiding the excessive upward deflection of the spring finger.

10. A cable connector assembly equipped with a cable set for mating with an external mating connector, comprising:

a plurality of contacts each having a contact section at a free end for electrical contact with the mating connector and a tail section at an opposed end thereof;

the cable set consisting of a plurality of juxtaposed cables each having at least a conductive signal segment and a grounding segment insulated from the signal segment, and a conductive grounding bar firmly jointed with the grounding segments of the cables;

housing means having a mating surface for contact with the mating connector, an joint surface opposite to the mating surface, a receiving space defined between both said mating and joint surfaces thereby receiving the cable set therein, and a plurality of passageways each retentively receiving the corresponding contact, of which the tail section is fixedly jointed with the corresponding signal segment of the cable set, and at least an elongated slot located adjacent to the passageways for restrictedly receiving the grounding bar jointed with the cables therein;

a conductive shield means attached outside the housing means, forming at least a spring finger inward extending into the receiving space but engagingly deflected outward by the grounding bar received therein thereby establishing a grounding path from the cables to the shield means.

11. The cable connector assembly as defined in claim 10, wherein said shield means further includes tabs extending outward opposite to said spring finger for electrically connecting to the mating connector.

12. The cable connector assembly as defined in claim 10, wherein said spring finger extends from a rear edge of the shield means.

13. A connector assembly for mating with an external mating connector, comprising:

a plurality of contacts each having a contact section at a free end for electrical contact with the mating connector and a tail section at an opposed end thereof;

housing means having a mating surface for contact with the mating connector, an joint surface opposite to the mating surface, a plurality of grooves for reception of the contacts therein, and at lest a recess defined along either of opposite lateral sides thereof;

an upper and lower shield members attached outside the housing means, respectively forming at least an upper claw with a first bent angle and a lower claw with a second angle at either of opposite lateral edges thereof wherein the first bent angle interferes with the second bent angle whereby the lower claw of the law shield member are elastically deflected by the upper claw of the upper shield member as soon as both of the claws are received within the corresponding recess of the housing means, thereby establishing an electrical and mechanical connection between both shield members.

14. The connector assembly as defined in claim 13, wherein each shield member further forms a bent flange adjacent to the corresponding claw thereby inversely hooking inward within the corresponding recess of the housing means.

15. The connector assembly as defined in claim 13, wherein the housing means further forms an ear portion with the recess on either of lateral sides thereof whereby the corresponding claw of each shield member can inversely hook rearward with the recess of the ear portion of the housing mean.

* * * * *